US006215973B1

(12) United States Patent
Shin

(10) Patent No.: US 6,215,973 B1
(45) Date of Patent: Apr. 10, 2001

(54) SQUEEGEE ROLLER CLEANING APPARATUS FOR LIQUID ELECTROPHOTOGRAPHIC PRINTER

(75) Inventor: Seong-soo Shin, Yongin (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/441,067

(22) Filed: Nov. 16, 1999

(30) Foreign Application Priority Data

Dec. 17, 1998 (KR) ..... 98-55747

(51) Int. Cl.[7] ..... G03G 15/10
(52) U.S. Cl. ..... 399/249
(58) Field of Search ..... 399/237, 249, 399/348

(56) References Cited

U.S. PATENT DOCUMENTS 6,049,684 * 4/2000 Nishikawa et al. ..... 399/249

* cited by examiner

*Primary Examiner*—William J. Royer
(74) *Attorney, Agent, or Firm*—Sughrue, Mion, Zinn, Macpeak & Seas, PLLC

(57) ABSTRACT

A squeegee roller cleaning apparatus for a liquid electrophotographic printer includes a plate installed at a tray, parallel to the axial direction of a squeegee roller, under a photoreceptor web to be capable of pivoting. A surface-contact blade member is supported at the plate so as to selectively surface-contact the outer circumferential surface of the squeegee roller. An elastic spring is coupled between the tray and the plate. A device makes the plate pivot such that the surface-contact blade member can contact or be separated from the outer circumferential surface of the squeegee roller.

6 Claims, 5 Drawing Sheets

SQUEEGEE ROLLER CLEANING APPARATUS FOR LIQUID ELECTROPHOTOGRAPHIC PRINTER

BACKGROUND OF THE INVENTION

1. Field of the Invention

The present invention relates to a squeegee roller cleaning apparatus for a liquid electrophotographic printer and, more particularly, to a squeegee roller cleaning apparatus for a liquid electrophotographic printer having a blade with an improved structure and shape for removing developer remaining between a squeegee roller and a photoreceptor web.

2. Description of the Related Art

FIG. 1 shows the structure of a conventional liquid electrophotographic printer. Referring to FIG. 1, a development unit of a conventional liquid electrophotographic printer includes a photoreceptor web 10 circulating by being supported by a plurality of rollers 11, a tray 12 installed under the photoreceptor web 10 for collecting developer remaining after being used for development, a development roller 14 supported by a development frame (not shown) and moving up and down by an elevating means (not shown), a manifold 20 for injecting developer into a gap G (hereinafter, referred to as a development gap) formed between the development roller 14 and the photoreceptor web 10, a development tank 13 for collecting and holding the developer injected into the development gap G, a development roller cleaning apparatus for removing developer adhering to the outer circumferential surface of the development roller 14, and a developer removing means for removing developer remaining on the photoreceptor web 10 after being used for the development.

The development roller cleaning apparatus consists of a brush roller 18 for cleaning developer adhering to the development roller 14, by being supported by the development tank 13 and rotating in contact with the development roller 14, and a development blade 22 having one end in contact with the outer circumference of the development roller 14 and the other end assembled to the body of the manifold 20, for removing developer remaining between the brush roller 18 and the development roller 14 and transferred to the surface of the development roller 14. Reference numeral 24 denotes a packing member for discharging developer in the development tank 13 into the tray 12 and reference numeral 26 denotes a stopper for limiting the movement of the packing member 24.

The developer removing means consists of a squeegee roller 15 installed adjacent to the development roller 14 for pressing and removing developer adhering to the photoreceptor web 10, an air injection nozzle 16 for removing developer by injecting air into a portion where the squeegee roller 15 contacts the photoreceptor web 10, a squeegee blade 17 for removing developer flowing down along the outer circumference of the squeegee roller 15 while being in contact with the surface of the squeegee roller 15.

During development, the development roller 14 ascends toward the photoreceptor web 10 to maintain the development gap G in the tray 12. As the development roller 14 moves, the development tank 13 and the manifold 20 are moved upward together. The manifold 20 injects developer into the development gap G and, as the development roller 14 rotates, an area for an electrostatic latent image formed on the surface of the photoreceptor web 10 is developed. Developer carrier adhering to the area for an electrostatic latent image on the photoreceptor web 10 is removed by the developer removing means.

In other words, the squeegee roller 15 is in contact with the photoreceptor web 10 and passively rotated thereby in a direction in which the photoreceptor web 10 travels. In doing so, the squeegee roller 15 presses the developer adhering to the electrostatic latent image area so that toner becomes filmy and most of the carrier other than the filmy toner is removed. Here, the air injection nozzle 16 injects air toward the squeegee roller 15. That is, the carrier squeezed by the squeegee roller 15 flowing along a contact line between the squeegee roller 15 and the photoreceptor web 10 meets the air injected by the air injection nozzle 16 to scatter and fall downward. Here, the blade 17 maintains a state of being separated a predetermined distance from the outer circumferential surface of the squeegee roller 15.

As shown in FIG. 2, after the development mode is terminated, the development roller 14 descends in the tray 12. As the development roller 14 moves down, the packing member 24 contacting the stopper 26 relatively ascends to open a lower portion of the development tank 13. Thus, the developer in the development tank 13 is discharged into the tray 12.

However, a drip-line is generated as developer continues to remain between the photoreceptor web 10 and the squeegee roller 15. The drip-line is generated when developer gathers at a portion where the squeegee roller 15 and the photoreceptor web 10 closely contact each other during development. To remove the drip-line developer, in a state in which the operating speed of the photoreceptor web 10 is reduced, a pressing force of the squeegee roller 15 which presses the photoreceptor web 10 is slightly reduced. Then, by driving the squeegee roller 15 to rotate in the reverse direction to the direction in which the photoreceptor web 10 travels, the drip-line developer is removed due to the rotation of the squeegee roller 15. The removed developer flows down along the squeegee roller 15 and falls into the tray 12 by being wiped by the blade 17. The developer falling into the tray 12 is collected on the bottom surface of the tray 12 and supplied to a circulation tank (not shown).

In the developer removing means of the development unit having the above structure, the squeegee blade 17 must satisfy the conditions as follows.

First, the developer falls downward without a hold up volume phenomenon occurring when the developer is maintained at a contact point between the leading edge of the blade and the squeegee roller, so that developer does not adhere to the surface of the blade.

Second, the developer must be completely removed so that the developer does not remain on the surface of the squeegee roller.

Third, the blade must not be flipped over to the reverse due to a rotational moment by the rotation of the squeegee roller. That is, as the blade is deformed by the friction with the squeegee roller, the leading edge of the blade must not be lifted, either partially or entirely, from the surface of the squeegee roller.

SUMMARY OF THE INVENTION

To solve the above problems, it is an objective of the present invention to provide a squeegee roller cleaning apparatus for a liquid electrophotographic printer in which the structure and shape of the blade are improved so that the efficiency in removing the developer remaining between the photoreceptor web and the squeegee roller is increased.

Accordingly, to achieve the above objective, there is provided a squeegee roller cleaning apparatus for a liquid electrophotographic printer, which comprises a plate installed at a tray, parallel to the axial direction of a squeegee roller, under a photoreceptor web to be capable of pivoting, a surface-contact blade member supported at the plate so as to selectively surface-contact the outer circumferential surface of the squeegee roller, an elastic spring coupled between the tray and the plate, and a means for making the plate pivot such that the surface-contact blade member can contact or be separated from the outer circumferential surface of the squeegee roller.

It is preferred in the present invention that the pivot means comprises a cam member installed at the tray to be capable of rotating so as to contact the plate, and a driving motor for driving the cam member.

Also, it is preferred in the present invention that the surface-contact blade member comprises a surface contact portion disposed to be inwardly rounded to the outer circumferential surface of the squeegee roller.

Also, it is preferred in the present invention that the radius of the surface-contact portion is less than that of the squeegee roller.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
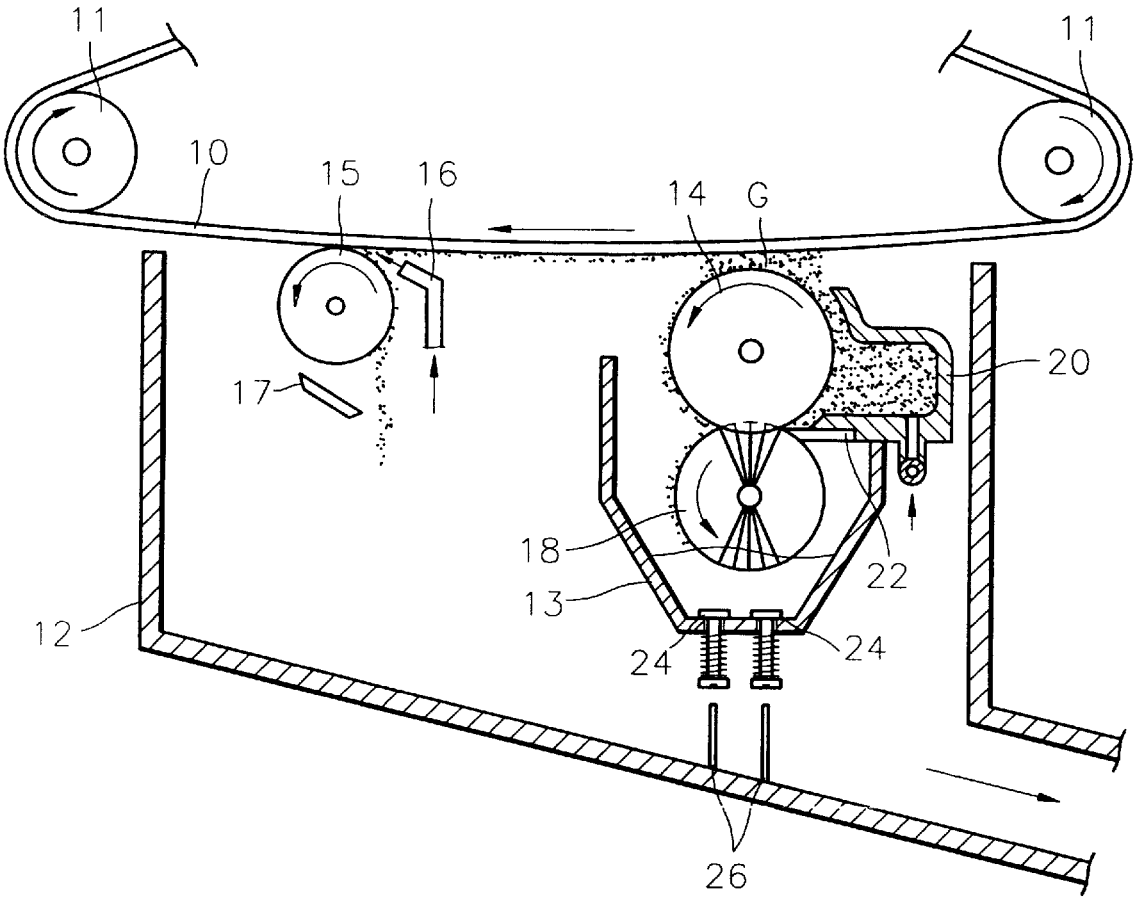
FIG. 1 (PRIOR ART)
FIG. 1 is a view showing the structure of a conventional liquid electrophotographic printer.
Figure 2:
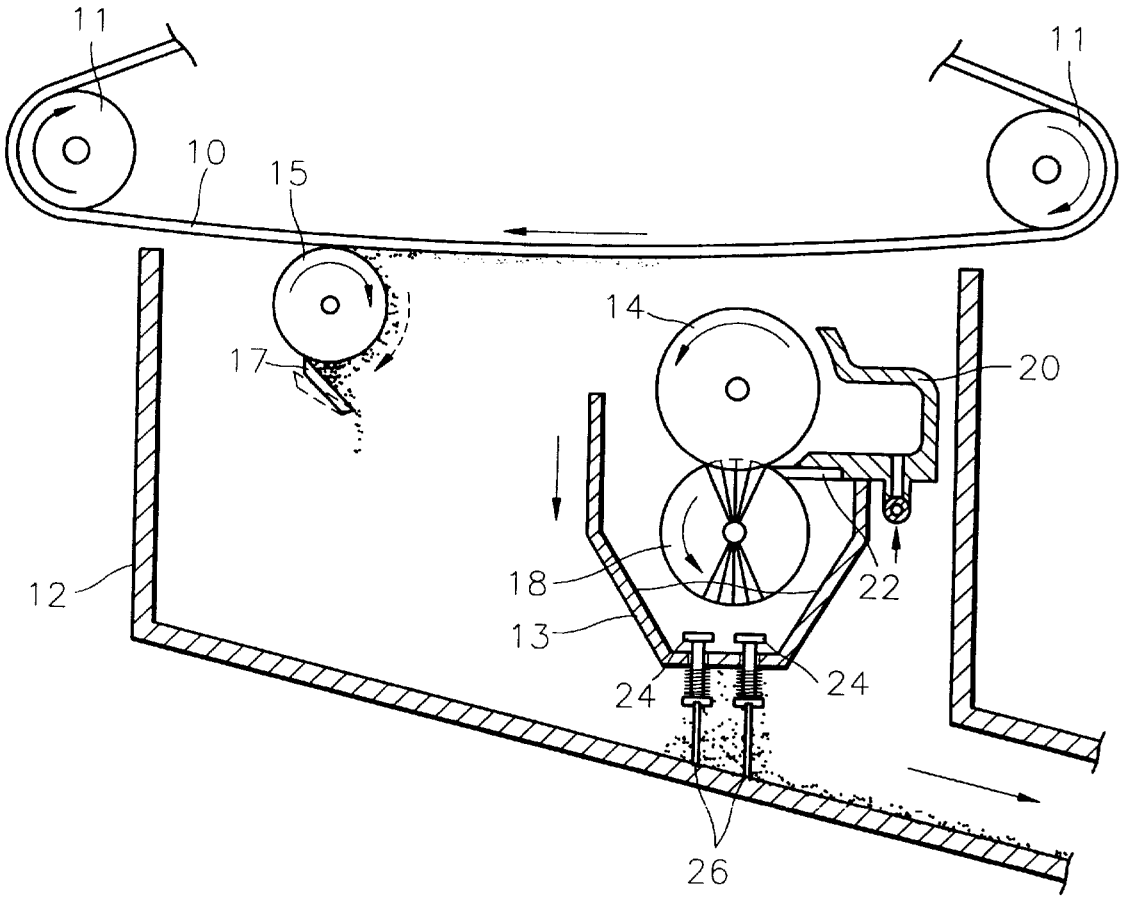
FIG. 2 (PRIOR ART)
FIG. 2 is a view showing the operation of the developer removing means when the development mode is terminated, in the liquid electrophotographic printer shown in FIG. 1.
Figure 3:
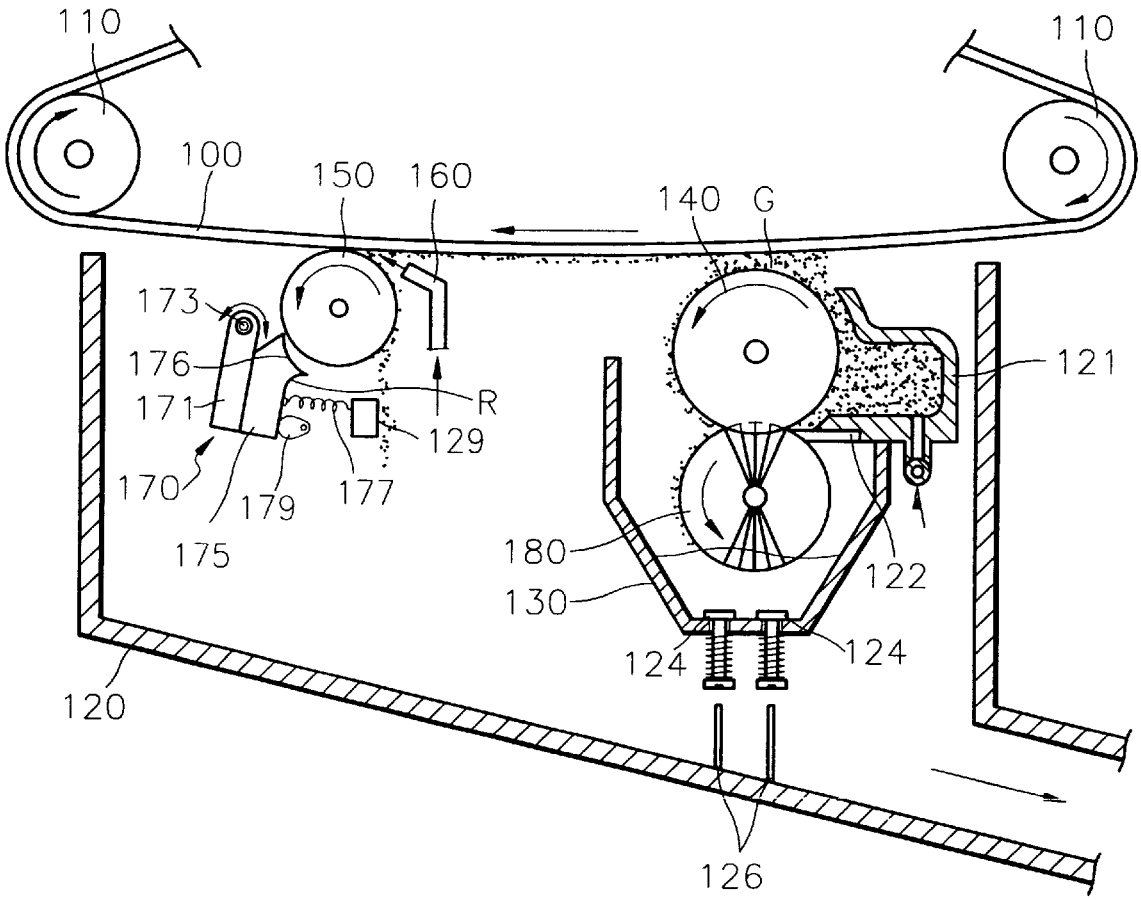
FIG. 3 is a view showing the operation of a developer removing means in a development mode, in a squeegee roller cleaning apparatus for a liquid electrophotographic printer according to the present invention.
Figure 4:
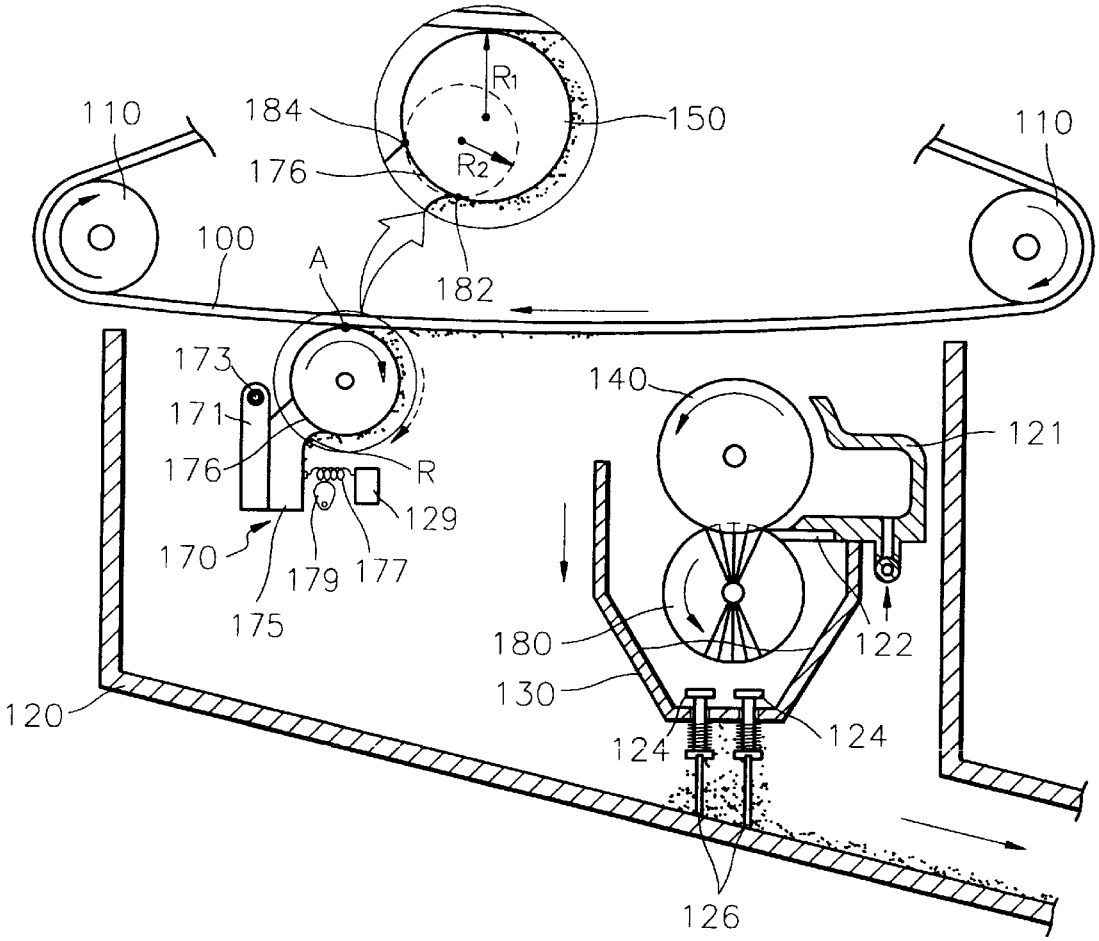
FIG. 4 is a view showing the operation of the developer removing means when the development mode is terminated, in the squeegee roller cleaning apparatus shown in FIG. 3.
Figure 5:
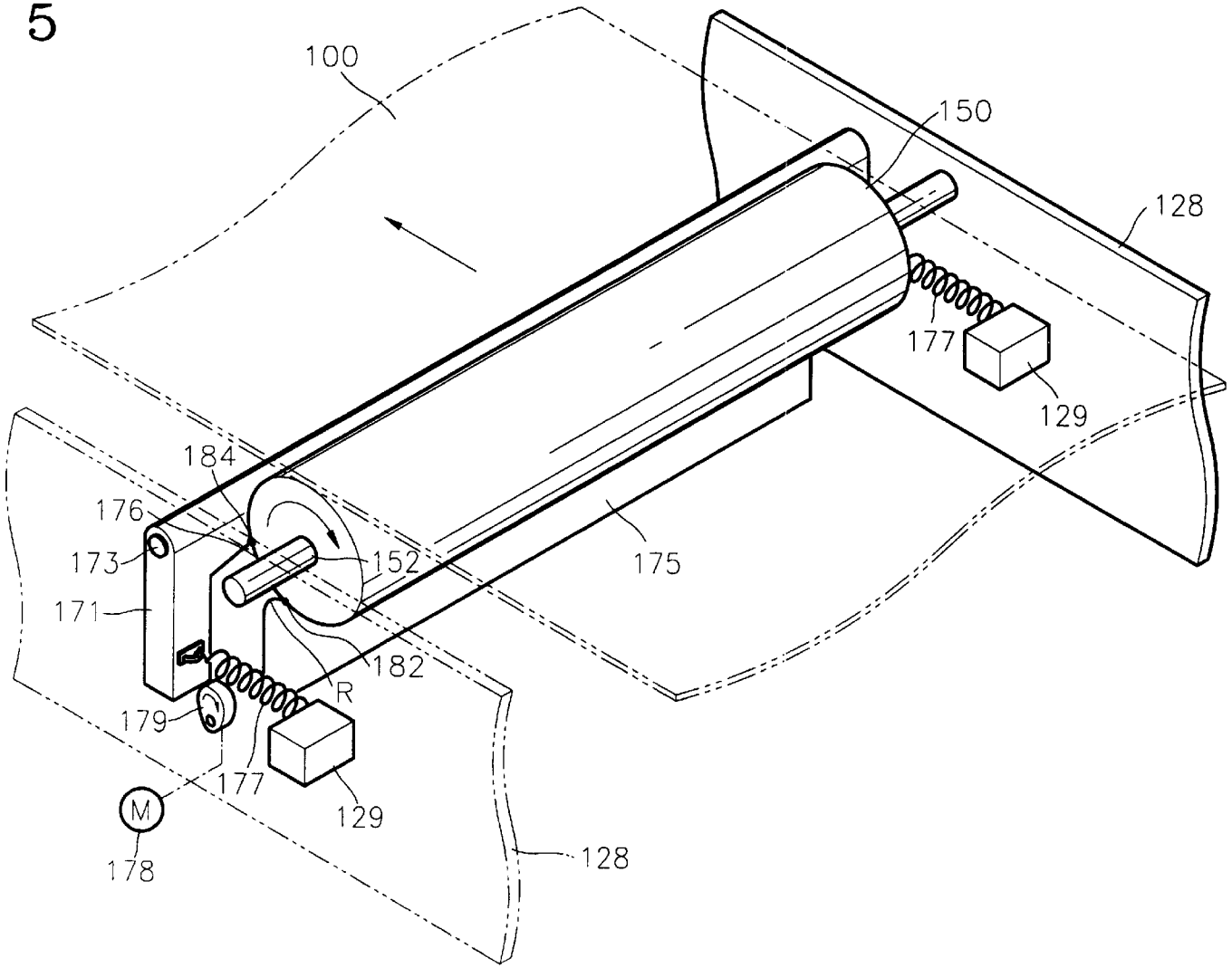
FIG. 5 is a perspective view showing major parts of FIG. 4.

Referring to FIGS. 3 through 5, a squeegee roller cleaning apparatus for a liquid electrophotographic printer according to the present invention includes a photoreceptor web 100 circulating by being supported by a plurality of rollers 110, a tray 120 installed under the photoreceptor web 100 for collecting developer remaining after being used for development, a development roller 140 supported by a development frame (not shown) and moving up and down by an elevating means (not shown), a manifold 121 for injecting developer into a gap G (hereinafter, referred to as a development gap) formed between the development roller 140 and the photoreceptor web 100, a development tank 130 for collecting and holding developer injected into the development gap G, by being supported by the manifold 121, a development roller cleaning apparatus for removing developer adhering to the outer circumferential surface of the development roller 140, and a developer removing means for removing developer remaining on the photoreceptor web 100 after being used for development.

The development roller cleaning apparatus consists of a brush roller 180 for cleaning developer adhering to the development roller 140, by being supported by the development tank 130 and rotating in contact with the development roller 140, and a development blade 122 having one end in contact with the outer circumference of the development roller 140 and the other end assembled to a body of the manifold 121, for removing developer remaining between the brush roller 180 and the development roller 140 and transferred to the surface of the development roller 140. Reference numeral 124 denotes a packing member for discharging developer in the development tank 130 into the tray 120 and reference numeral 126 denotes a stopper for limiting the movement of the packing member 124.

The developer removing means consists of a squeegee roller 150 installed adjacent to the development roller 140 for pressing and removing developer adhering to the photoreceptor web 100, and a blade assembly 170 for removing the developer flowing down along the outer circumference of the squeegee roller 150 while being in contact with the surface of the squeegee roller 150 in a drip-line removing mode.

The blade assembly 170 includes a plate 171 supported by the tray 120 and a surface-contact blade member 175 installed at the plate 171. The tray 120 is fixed to the main body of the printer for collecting developer after being used for the development and supplying the developer to a circulation tank (not shown).

The plate 171 is installed parallel to the lengthwise direction of a rotation shaft 152 of the squeegee roller 150 (see FIG. 5) to face the squeegee roller 150. Also, the plate 171 is installed to be capable of pivoting by a pivot means with respect to a hinge shaft 173 having both ends fixed to side surfaces 128 of the tray 120.

The surface-contact blade member 175 is installed at the side surface of the plate 171 which faces the squeegee roller 150. Also, the surface-contact blade member 175 has a surface contact portion 176 which is inwardly rounded to comform to the outer circumferential surface of the squeegee roller 150. The surface contact portion 176 has first and second tangential portions 182 and 184 whose end portions are operative to contact the outer circumference of the squeegee roller 150. The radius $R_2$ of the surface contact portion 176 is preferably smaller than the radius R of the squeegee roller 150 (see FIG. 4).

The lower portion of the plate 171 is coupled to a protrusions 129 formed at both side surfaces 128 of the tray 120 by elastic springs 177 such as compression springs. The elastic spring 177 elastically bias the surface-contact blade member 175 to be pressed against the outer circumference of the squeegee roller 150 by a restoring force thereof.

The pivot means includes a cam member 179 supported by both side surfaces 128 of the tray 120 and rotating to allow the plate 171 to contact or be separated from the squeegee roller 150. The cam member 179 is driven by a driving motor 178.

In the operation of the squeegee roller cleaning apparatus for a liquid electrophotographic printer according to a preferred embodiment of the present invention, referring to FIG. 3, during development, the development roller 140 supported to the development tank 130 ascends toward the photoreceptor web 100 in the tray 120 maintaining the development gap G from the photoreceptor web 100. Then, the manifold 121 injects developer into the development gap G. The development roller 140 presses the developer to adhere to an area for an electrostatic latent image of the photoreceptor web 100. Here, the brush roller 180 in the development tank 130 contacts the development roller 140 to clean the developer remaining on the surface thereof. The brush roller 180 rotates in a direction identical to that of the development roller 140. The blade 122 removes developer remaining between the brush roller 180 and the development roller 140 to be transferred to the surface of the development roller 140. The removed developer is collected in the development tank 130 and stored therein temporarily.

Developer adhering to the electrostatic latent image area of the photoreceptor web 100 is squeezed by being pressed by the squeegee roller 150 to make the toner filmy. Most of the carrier except for the filmy toner falls into the tray 120. Here, the squeegee roller 150 is passively driven by the circulating photoreceptor web 100 and accordingly rotated in the same direction as the circulating direction of the photoreceptor web 100. The liquid carrier squeezed by the squeegee roller 150 flows along the contact line between the squeegee roller 150 and the photoreceptor web 100 and is blown by air injected by the air injection nozzle 160 to fall.

When the cam member 179 is rotated by driving the driving motor 178, the plate 171 pivots clockwise on the hinge shaft 173, overcoming an elastic force of the elastic springs 177. Then, the surface-contact blade member 175 is separated a predetermined distance from the outer circumferential surface of the squeegee roller 150. The reason for separating the surface-contact blade member 175 from the squeegee roller 150 so as not to contact it, is to prevent lowering of the rotation speed of the squeegee roller 150 due to contact of the surface-contact blade member 175 and the squeegee roller 150 so that damage to an image formed on the electrostatic latent image area on the photoreceptor web 100 can be prevented.

FIG. 4 shows the operation of the developer removing means when the development mode is terminated, in the squeegee roller cleaning apparatus according to the preferred embodiment of the present invention. Referring to the drawing, the development roller 140 descends toward the bottom of the tray 120, together with the development tank 130. Next, the packing member 124 is moved up by the stopper 126 to open the bottom surface of the development tank 130. Then, the developer in the development tank 130 flows down on the bottom surface of the tray 120 through an opening where the packing member 124 is disposed. As the bottom surface of the tray 120 is inclined at a predetermined angle with respect to the widthwise direction of the photoreceptor web 100, the developer flows downward along the inclined surface and is provided to the circulation tank (not shown).

After development is terminated, developer remaining at a contact point A between the photoreceptor web 100 and the squeegee roller 150 remains so that a drip-line is generated. That is, part of the developer having been squeezed by the squeegee roller 150 does not fall but continues to remain at the contact point A between the side of the squeegee roller 150 and the photoreceptor web 100. The drip-line should be removed periodically to maintain a clear image.

To achieve the above purpose, the squeegee roller 150 is lowered so that a rotational load applied to the photoreceptor web 100 by a pressing force by the squeegee roller 150 is reduced, and the squeegee roller 150 is reversely rotated thereafter.

Simultaneously, the driving motor 178 is rotated so that the cam member 179 is rotated counterclockwise. Then, the plate 171 pivots counterclockwise toward the outer circumference of the surface-contact blade member 175 by a restoring force of the elastic springs 177 so that the surface contact portion 176 of the surface-contact blade member 175 contacts the outer circumferential surface of the squeegee roller 150. Here, the space between the outer circumferential surface of the squeegee roller 150 and the surface contact portion 176 disappears as the surface contact portion 176 completely contacts the outer circumferential surface of the squeegee roller 150 by a restoring force of the elastic springs 177. This is because the radius $R_2$ of the surface contact portion 176 is formed to be relatively less than the radius $R_1$ of the squeegee roller 150 so that the contact surface between the first and second tangential portions 182 and 184 can firmly contact the outer circumferential surface of the squeegee roller 150 and the surface-contact blade member 175 is formed of a soft material.

Thereafter, developer remaining at one side of the squeegee roller 150 flows along the circumference of the squeegee roller 150 as the dotted arrow shown in FIG. 4 indicates. Developer is wiped by the surface-contact blade member 175 and prevented from being carried further along the outer circumferential surface of the squeegee roller 150. That is, the developer is completely removed by being wiped at the first tangential portion 182 as the outer circumferential surface of the squeegee roller 150 and the surface contact portion 176 are completely in contact with each other. Accordingly, the developer flows down by being guided along a rounded portion R of the surface-contact blade member 175. Thus, the hold up volume phenomenon of developer remaining between the outer circumference of the squeegee roller 150 and the first tangential portion 182 can be prevented. The developer falling by being blocked by the surface-contact blade member 175 is collected in the tray 120 and discharged to the circulation tank (not shown).

As the plate 171 biased by the elastic springs 177 pivots on the hinge shaft 173, the first tangential portion 182 of the surface contact portion 176 is prevented from being lifted, either partially or entirely, from the surface of the squeegee roller 150 as the surface-contact blade member 175 is deformed due to the friction with the squeegee roller 150 by a rotational moment of the squeegee roller 150.

As described above, the squeegee roller cleaning apparatus for a liquid electrophotographic printer according to the present invention includes a blade member which surface-contacts corresponding to the outer circumferential surface of the squeegee roller so that the generation of a hold up volume generated at the contact point between the blade member and the squeegee roller is reduced, thereby preventing the developer from adhering thereto.

Also, as developer does not remain on the surface of the squeegee roller, efficiency in cleaning is improved. The blade member is prevented from being turned over due to the rotational moment by the rotational driving of the squeegee roller. Consequently, efficiency in removing developer remaining between the photoreceptor web and the squeegee roller can be improved.

It is noted that the present invention is not limited to the preferred embodiment described above, and it is apparent that variations and modifications by those skilled in the art can be effected within the spirit and scope of the present invention defined in the appended claims.

What is claimed is:

1. A squeegee roller cleaning apparatus for a liquid electrophotographic printer, said apparatus comprising:

a plate installed at a tray, parallel to an axial direction of a squeegee roller, under a photoreceptor web and operative to pivot;

a surface-contact blade member supported at said plate so as to selectively surface-contact an outer circumferential surface of the squeegee roller;

at least one elastic spring coupled between said tray and said plate; and means for making said plate pivot such that said surface-contact blade member either contacts or separates from the outer circumferential surface of the squeegee roller.

2. The squeegee roller cleaning apparatus as claimed in claim 1, wherein said pivot means comprises:

a cam member installed at said tray and operative to rotate so as to contact said plate; and a driving motor which drives said cam member.

3. The squeegee roller cleaning apparatus as claimed in claim 1, wherein said surface-contact blade member comprises:

a surface contact portion which is inwardly rounded to conform to the outer circumferential surface of the squeegee roller.

4. The squeegee roller cleaning apparatus as claimed in claim 3, wherein the radius of the surface-contact portion is less than that of said squeegee roller.

5. A squeegee roller cleaning apparatus for a liquid electrophotographic printer which includes a photoreceptor web, a tray installed under the photoreceptor web, and a squeegee roller, said apparatus comprising:

a plate installed at the tray, parallel to an axial direction of the squeegee roller, under the photoreceptor web and operative to pivot;

a surface-contact blade member supported at said plate so as to selectively surface-contact an outer circumferential surface of the squeegee roller;

at least one elastic spring coupled between the tray and said plate; and a pivot mechanism which pivots said plate such that said surface-contact blade member either contacts or separates from the outer circumferential surface of the squeegee roller.

6. The squeegee roller cleaning apparatus as claimed in claim 5, wherein said pivot mechanism comprises:

a cam member installed at said tray and operative to rotate so as to contact said plate; and a driving motor which drives said cam member.

* * * * *